US008746198B2

(12) United States Patent
Sasaki

(10) Patent No.: US 8,746,198 B2
(45) Date of Patent: Jun. 10, 2014

(54) OPERATION CONTROL SYSTEM FOR AN ENGINE AND VEHICLE COMPRISING THE SAME

(75) Inventor: Yuichi Sasaki, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 1518 days.

(21) Appl. No.: 12/351,798

(22) Filed: Jan. 9, 2009

(65) Prior Publication Data

US 2009/0183707 A1 Jul. 23, 2009

(30) Foreign Application Priority Data

Jan. 18, 2008 (JP) ..... 2008-009386

(51) Int. Cl.

| | |
|---|---|
| ***F02D 41/06*** | (2006.01) |
| ***F02M 1/00*** | (2006.01) |
| ***F02P 15/00*** | (2006.01) |
| ***F02P 5/00*** | (2006.01) |

(52) U.S. Cl.
USPC ..... 123/179.17; 123/179.5; 123/406.53

(58) Field of Classification Search
USPC ..... 123/179.17, 179.24, 478, 490, 491, 123/497, 198 DB, 198 DC, 406.12, 406.53, 123/406.58; 701/113
See application file for complete search history.

(56) References Cited

U.S. PATENT DOCUMENTS

| | | | | |
|---|---|---|---|---|
| 5,584,275 | A * | 12/1996 | Taruya | 123/406.14 |
| 7,905,217 | B2 * | 3/2011 | Namari et al. | 123/491 |
| 7,930,092 | B2 * | 4/2011 | Tokugawa et al. | 701/113 |
| 2004/0025839 | A1 * | 2/2004 | Kashibata et al. | 123/406.47 |
| 2005/0005914 | A1 * | 1/2005 | Tamechika et al. | 123/478 |
| 2006/0185648 | A1 * | 8/2006 | Felton | 123/446 |

FOREIGN PATENT DOCUMENTS

| | | | |
|---|---|---|---|
| JP | 2002-21624 | A | 1/2002 |
| JP | 2002021624 | A * | 1/2002 |
| JP | 3827059 | | 7/2006 |

* cited by examiner

*Primary Examiner* — John Kwon
*Assistant Examiner* — Sizo Vilakazi
(74) *Attorney, Agent, or Firm* — Keating & Bennett, LLP

(57) ABSTRACT

An operation control system for an engine having at least one piston includes an engine control unit which drives a fuel pump for supplying fuel to an injector. The engine control unit is configured to perform a control function to cut the electric power supply to the fuel pump when the piston arrives at a position in the vicinity of compression top dead center in the cylinder of the engine.

21 Claims, 9 Drawing Sheets

OPERATION CONTROL SYSTEM FOR AN ENGINE AND VEHICLE COMPRISING THE SAME

PRIORITY INFORMATION

This patent application is based on and claims priority under 35 U.S.C. §119 to Japanese Patent Application No. 2008-009386, filed on Jan. 18, 2008, the entire contents of which is hereby expressly incorporated by reference.

TECHNICAL FIELD

The present invention relates to operation control systems for engines and vehicles comprising the same, and more particularly, relates to operation control systems for engines including a control module and vehicles comprising the same.

BACKGROUND

Conventionally, an operation control system for an engine and a vehicle comprising the same are known (see Japanese Patent No. 3827059, for example). Japanese Patent No. 3827059 discloses a start control system for an engine, comprising an injector (a fuel injection device) which injects fuel to the engine which has a piston, a fuel pump which supplies fuel to the injector, an alternating current generator (a power generation module) which generates electric power when the engine is driven and supplies electric power for driving of the injector and the fuel pump, and a control module which controls the driving of the injector and the fuel pump and which is activated by electric power from the alternating current generator. The start control system for the engine is configured to stop electric power supply to the fuel pump, electric power consumption of which is large, in a predetermined term in the case where electric power is supplied to other electric equipment such as the injector, so that the electric power supplied to the control module from the alternating current generator is not considerably decreased during a predetermined period after starting of the engine.

However, in the start control system for an engine disclosed in the abovementioned Japanese patent, the electric power amount which is generated by the engine is not considered while the electric power consumption by the electric equipment such as the injector is considered. Therefore, there is a problem in the case when the operation of the control module stops because the electric power supplied to the control module becomes smaller than needed to operate the control module.

SUMMARY

The present invention has been devised to solve, or at least ameliorate, the abovementioned problem. To this end, one object of the present patent document is to provide an operation control system for an engine which can suppress the operation of the control module from being stopped even in the case where the generated electric power decreases due to a decrease of driving force of the engine. Other objects, features, and advantages will become apparent from the following description taken together with the drawings.

In order to achieve the abovementioned object, according to a first aspect, an operation control system for an engine, which is designed to be started by utilizing electric power manually generated with force of a human's hand or foot, is provided. The operation control system comprises a control module which drives a fuel pump for supplying fuel to a fuel injection device which injects fuel to the engine having a piston, wherein the control module is configured to perform a control function to cut the electric power supply to the fuel pump when the piston arrives at a position in the vicinity of the compression top dead center.

With the operation control system for an engine according to the first aspect, as mentioned above, the control module is configured to perform the control function to cut the electric power supply to the fuel pump when the piston arrives in the vicinity of the compression top dead center. Accordingly, the electric power supply to the fuel pump is stopped when the amount of power generated is decreased due to a decrease of the sliding speed of the piston in accordance with the arriving of the piston at the compression top dead center. Therefore, the amount of the electric power supplied to the control module can be more reliably ensured because electric power is not supplied to the fuel pump during this period. Consequently, electric power shortage for the control module can be suppressed. In this manner, operation of the control module can be suppressed from being stopped even in the case where the generated electric power is decreased due to the decrease of the drive force of the engine.

A vehicle according to a second aspect of the present invention comprises: an engine having a piston; a fuel injection device which injects fuel to the engine; a fuel pump for supplying fuel to the fuel injection device; a power generator which supplies electric power for driving the fuel injection device and the fuel pump; a manual start device which manually starts the power generator as well as the engine; and a control module which controls driving of the fuel injection device and the fuel pump and to which electric power is supplied from the power generator, wherein the control module is configured to perform a control function to cut the electric power supply to the fuel pump from the power generator when the piston arrives in the vicinity of the compression top dead center.

With the vehicle according to the second aspect, as mentioned above, the control module is configured to perform the control function to cut the electric power to the fuel pump when the piston arrives in the vicinity of the compression top dead center. Accordingly, the electric power supply to the fuel pump is stopped when the amount of power generated is decreased due to the decrease of the sliding speed of the piston in accordance with the arriving of the piston at the compression top dead center. Therefore, the amount of the electric power supplied to the control module can be more reliably ensured because electric power is not supplied to the fuel pump during this period. Consequently, electric power shortage for the control module can be suppressed. In this manner, operation of the control module can be suppressed from being stopped even in the case where the generated electric power is decreased due to the decrease of the drive force of the engine.

DETAILED DESCRIPTION

In the following, embodiments of the present invention are described with reference to the drawings.

Figure 1:
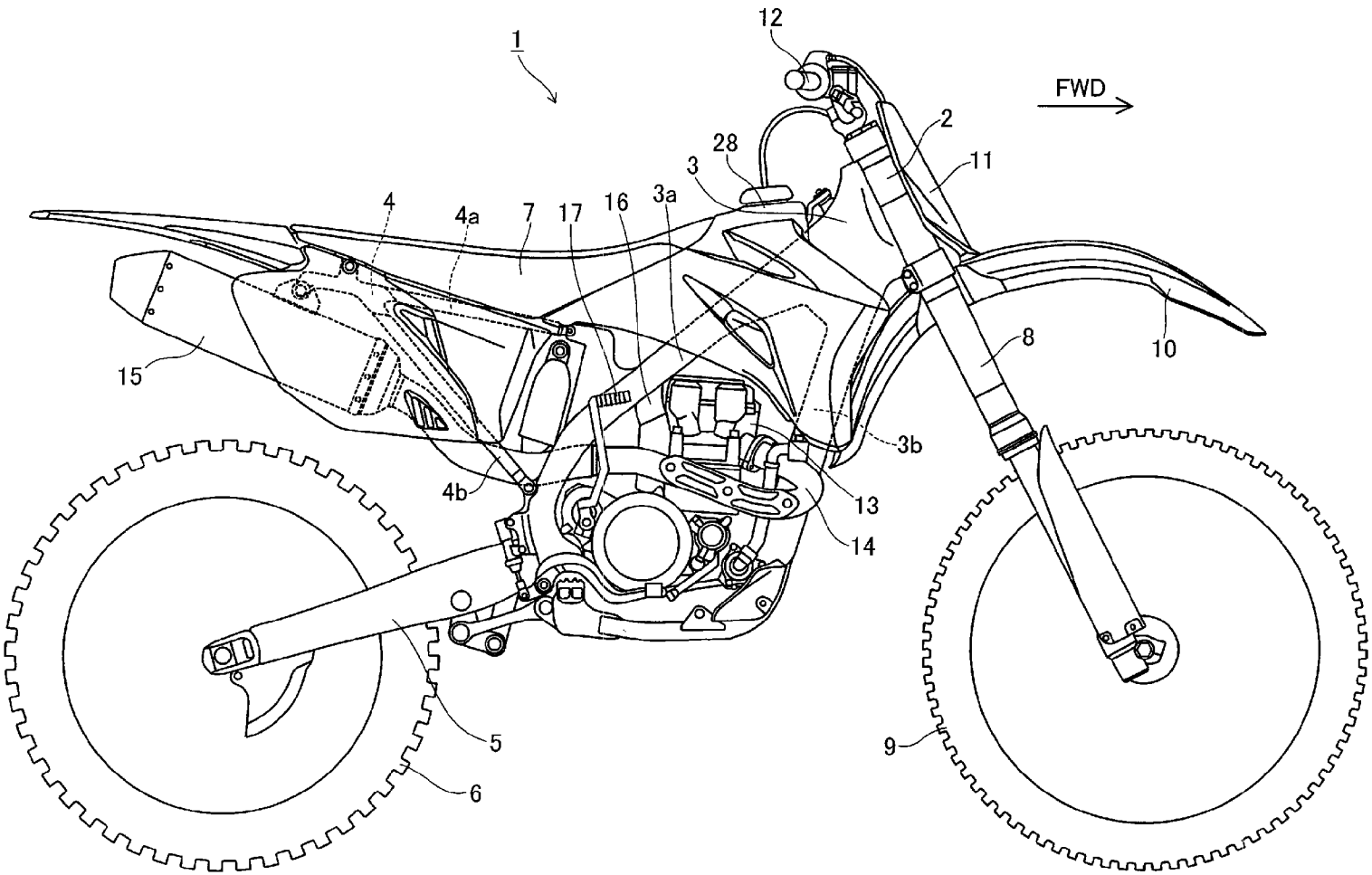
FIG. 1 is a side view showing a motorcycle according to an embodiment of the present invention.

FIG. 1 is a side view of a motorcycle according to an embodiment of the present invention. FIGS. 2-5 and 7-9 relate to the structure and operation of the motorcycle shown in FIG. 1. In the figures, the direction of the arrow FWD indicates the "front side" in the traveling direction of the motorcycle.

As shown in FIG. 1, a main frame 3 is disposed at a rear side of a head pipe 2. Further, the main frame 3 has an upper frame portion 3*a* which extends rearward from the upper side and a lower frame portion 3*b* which extends rearward from the lower side. Further, an upper frame portion 4*a* and a lower frame portion 4*b* of a rear frame 4 are respectively connected to the center part and the rear part of the upper frame portion 3*a* of the main frame 3. The head pipe 2, the main frame 3, and the rear frame 4 form a body frame.

Further, a pivot shaft (not shown) is disposed at the rear of the upper frame portion 3*a* of the main frame 3. A rear arm 5 is supported at its front end by the pivot shaft, so as to be able to pivot in the vertical direction. A rear wheel 6 is rotatably coupled to the rear end of the rear arm 5. A fuel tank 28 is arranged above the upper frame portion 3*a* of the main frame 3. A seat 7 is arranged at the rear side of the fuel tank 28.

Furthermore, a front fork 8 having suspension for absorbing impact in the vertical direction is rotatably mounted to the head pipe 2 so as to operably extend below the head pipe 2. A front wheel 9 is rotatably coupled to the bottom end of front fork 8. A front fender 10 is arranged above the front wheel 9. A number plate 11 to cover the front side of the head pipe 2 is disposed at the front side of the head pipe 2. A handle 12 is rotatably disposed above the head pipe 12.

In addition, an engine 13 is mounted below the upper side frame portion 3*a* of the main frame 3. An exhaust pipe 14 is attached to a front portion of the engine 13. The exhaust pipe 14 extends rearward and is connected to a muffler 15. An intake pipe 16 is attached to a rear portion of the engine 13.

In the present embodiment, a kick pedal 17 for starting the engine 13 with a user's foot is attached to a rear portion of the engine 13. Here, the kick pedal 17 is an example of a "manual start device" of the present invention. A function of kick pedal 17 is to drive a generator 37 (FIG. 2), which is described later, by being rotated downward with a user's foot at the time of starting the engine 13.

Figure 2:
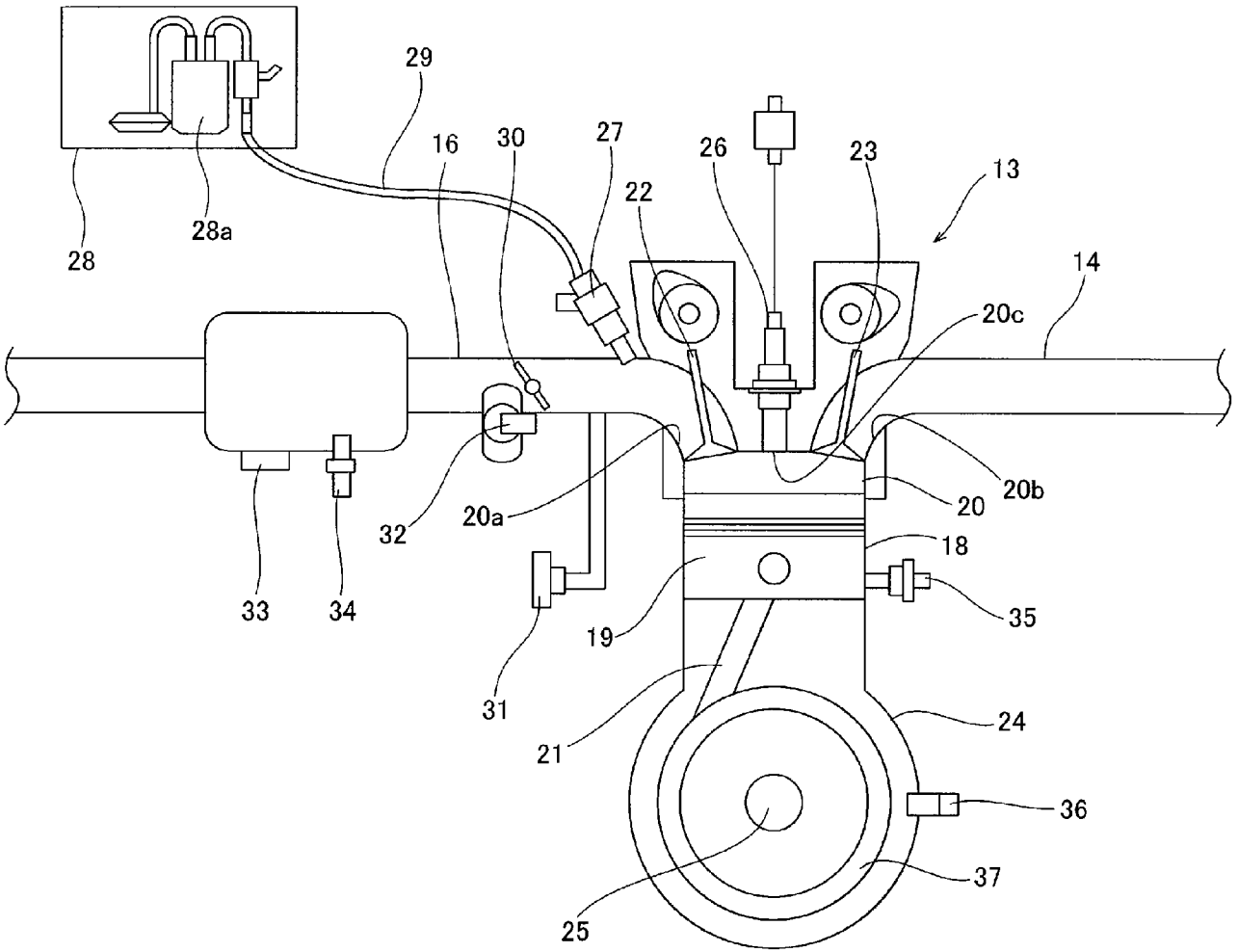
FIG. 2 is a schematic diagram illustrating structure disposed in the vicinity of the engine of the motorcycle shown in FIG. 1.

As shown in FIG. 2, a cylinder 18, a piston 19, which slides vertically inside the cylinder 18, and a cylinder head 20 which is arranged at the upper portion of the cylinder 18 form part of the engine 13. One end of a connecting rod 21 is rotatably attached to the piston 19. The cylinder head 20 is arranged so as to close one opening of the cylinder 18. An intake port 20*a* and an exhaust port 20*b*, which are disposed above the cylinder 18, are formed in the cylinder head 20. An intake valve 22 and an exhaust valve 23 are disposed in the intake port 20*a* and the exhaust port 20*b*, respectively. Further, a combustion chamber 20*c* is formed in a portion of the cylinder 18, one opening of which is closed by the lower part of the cylinder head 20. The intake port 20*a* is used to supply a mixture of air and fuel to the combustion chamber 20*c*. An intake pipe 16 is connected to the intake port 20*a*. The exhaust port 20*b* is provided to discharge residual gases after combustion from the combustion chamber 20*c*.

The exhaust pipe 14 is connected to the exhaust port 20*b*. A crankcase 24 is arranged below the cylinder 18, and a crankshaft 25 is arranged in the crankcase 24. The other end of the connecting rod 21 is rotatably attached to the crankshaft 25. The crankshaft 25 is configured to be rotatable by the movement of the connecting rod 21 in accordance with the vertical sliding of the piston 19 inside the cylinder 18. Further, an ignition plug 26 which ignites the mixture of air and fuel is operatively disposed in the cylinder head 20.

In the present embodiment, the engine 13 is a four-stroke engine comprising an intake stroke, a compression stroke, a combustion (power) stroke and an exhaust stroke in accordance with the vertical sliding movement of the piston 19. Specifically, in the intake stroke, the engine 13 is configured so that the intake port 20*a* is opened and the air and fuel mixture flows into the combustion chamber 20*c* when the piston 19 slides downward and the intake valve 22 is lifted by a cam lobe. Further, the piston 19 is configured to slide down to the intake bottom dead center which is the bottom dead center of the cylinder 18.

The engine 13 is configured so that in the compression stroke the intake port 20*a* is closed by the intake valve 22 and the air and fuel mixture in the cylinder 18 is compressed when the piston 19 slides upward from the intake bottom dead center. The piston 19 is configured to slide up to the compression top dead center which is the top dead center of the cylinder 18. As the piston 19 slides up toward the top dead center, resistance increases in accordance with compression of the mixture. Therefore, the sliding force of the piston 19 decreases when the piston 19 moves in the vicinity of the compression top dead center. Consequently, the rotational force of the crankshaft 25 decreases when the piston 19 slides up in the vicinity of the compression top dead center.

The engine 13 is configured so that in the combustion stroke the air and fuel mixture, which is compressed by the piston 19 having arrived at the compression top dead center, is ignited with a spark generated by the ignition plug 26 at which point fuel combustion occurs. Thereafter, the piston 19 slides downward from the compression top dead center. In this case, the piston 19 is configured to slide down to the combustion bottom dead center, which is the bottom dead center of the cylinder 18, due to the combustion of the air and fuel mixture which is expanded due to the combustion of the fuel.

The engine 13 is configured so that in the exhaust stroke the exhaust port 20*b* is opened as the exhaust valve 23 is lifted by a cam lobe when the piston slides upward from the combustion bottom dead center. In addition, the engine 13 is configured so that the combustion gas in the combustion chamber 20*c* is exhausted through the exhaust port 20*b* by being pushed out upward by the piston 19. The piston 19 is configured to slide up to the exhaust top dead center which is the top dead center of the cylinder 18.

In the present embodiment, an injector 27, which injects fuel to the upstream side of the intake port 20*a*, is arranged at the intake pipe 16. Here, the injector 27 is an example of a "fuel injection device" of the present invention, as other fuel injection devices may also be used. A fuel pump 28*a* which supplies fuel from fuel tank 28 to the injector 27 is connected to the injector 27 via a hose 29. Further, a throttle valve 30 which opens and closes to adjust the flow rate of air flowing into the intake port 20*a* is disposed within the intake pipe 16 upstream from injector 27.

A pipe pressure sensor 31, which detects air pressure in the intake pipe 16, a throttle position sensor 32, which detects the extent of the opening of the throttle valve 30, an atmospheric pressure sensor 33, which detects atmospheric pressure, and an atmospheric temperature sensor 34, which detects atmospheric temperature, are operatively coupled to the intake pipe 16. A water temperature sensor 35, which detects water temperature in a water jacket (not shown) which cools the cylinder 18 with cooling water, and a crank angle sensor 36, which detects the rotational position of the crankshaft 25, are arranged at the engine 13. The later-mentioned ECU (Engine Control Unit) 38 (see FIG. 3) is configured to control the adjustment of the fuel injection amount of the injector 27 based on the detection signals received from pipe pressure sensor 31, the throttle position sensor 32, the atmospheric pressure sensor 33, the atmospheric temperature sensor 34, the water temperature sensor 35 and the crank angle sensor 36. Here, the crank angle sensor 36 is an example of a "sensor module" for use in accordance with the present invention, as other sensor modules may also be used.

Figure 4:
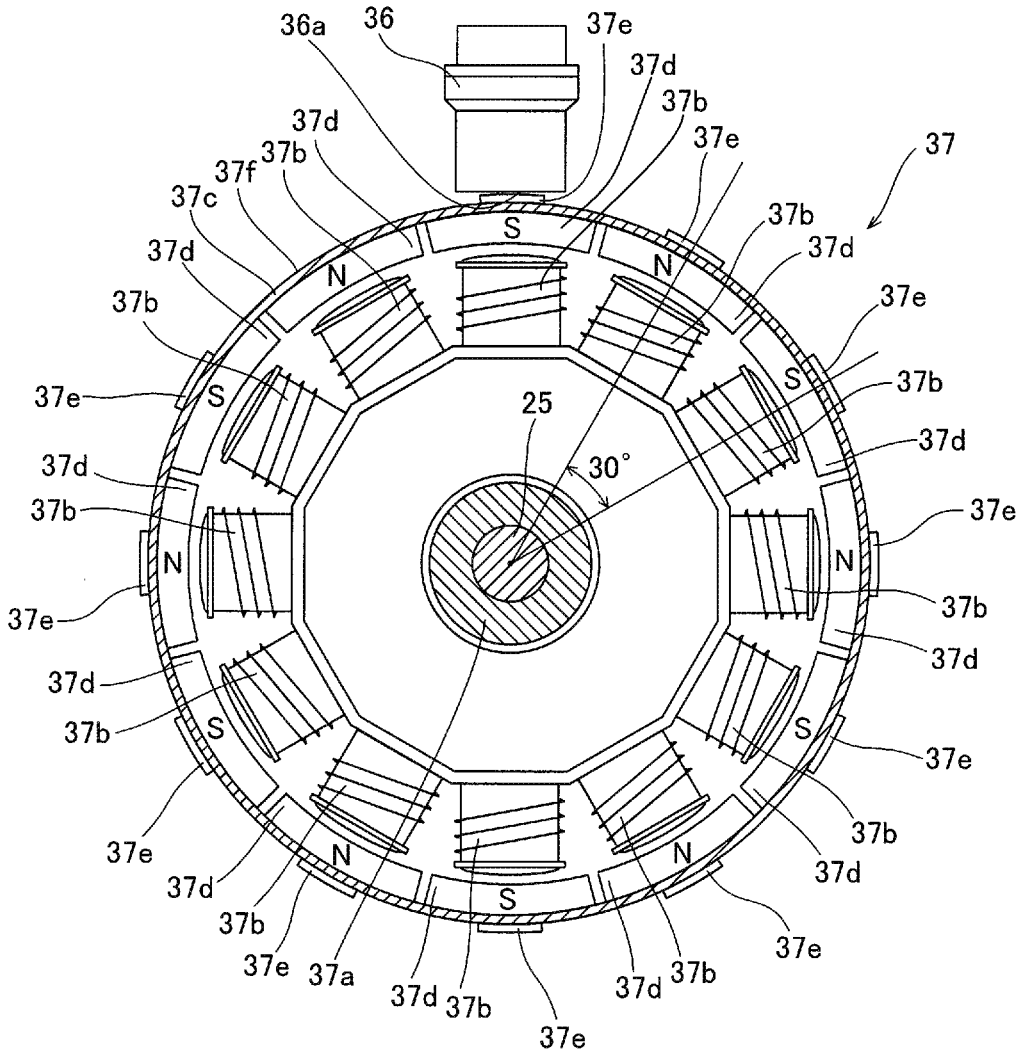
FIG. 4 is a sectional view showing the structure of a generator of the motorcycle shown in FIG. 1.

In the present embodiment, the generator 37, which is operated in accordance with the rotation of the crankshaft 25, is disposed inside the crankcase 24, as shown in FIG. 2. Here, the generator 37 is an example of a "power generation module" for use in accordance with the present invention, as other power generation modules may also be used. The generator 37 is configured to supply power to the ignition plug 26, the injector 27 and the fuel pump 28*a*. As shown in FIG. 4, the generator 37 has a core portion 37*a*, which is annular in cross-section and which is disposed on the outside of crankshaft 25, twelve coil portions 37*b* disposed at about every 30° relative to the core portion 37*a* (as shown in FIG. 4), a flywheel 37*c*, which is disposed outside the coil portions 37*b*, twelve magnets 37*d* which are disposed at the inner face of the flywheel corresponding to the twelve coil portions 37*b*, and eleven projecting portions 37*e* which are disposed at about a 30° pitch (angle between neighboring bisectors) so as to face eleven of the magnets 37*d* and thereby sandwich the flywheel 37*c* there between.

In the present invention, the flywheel 37*c* is arranged concentrically with the core portion 37*a*. Since the core portion 37*a* is fixed to the crankcase 24 (see FIG. 2), the core portion 37*a* and the coil portions 37*b* are configured not to rotate. On the other hand, the flywheel 37*c* is configured to rotate with the crankshaft 25. Therefore, the flywheel 37*c*, the magnets 37*d* and projecting portions 37*e* are configured to rotate in with the rotation of the crankshaft 25. The generator 37 is an alternating current (AC) generator. The projecting portions 37*e* are provided for detection of the rotational angle position and rotational speed of the crankshaft 25. Specifically, a pulse (crank pulse signal shown in FIG. 5), which is generated when a projecting portion 37*e* passes by the detection surface 36*a* of the crank angle sensor 36 (see FIG. 5), is detected by the later-mentioned ECU 38 (see FIG. 3). Projecting portions 37*e* rotate in accordance with the rotation of the flywheel 37*c*.

An extended gap portion 37*f*, having an angular width of about 60°, is provided on the outside of the flywheel 37*c* by omitting one projecting portion 37*e* opposite one magnet 37*d*. The ECU 38 (see FIG. 3) is configured to determine that the crankshaft 25 has passed a reference rotation position when the extended gap portion 37*f* passes by detection surface 36*a* of the crank angle sensor 36. The ECU 38 is also configured to detect the rotational angle and speed of crankshaft 25 based on the number and rate of crank pulse signals detected thereafter from crank angle sensor 36 (see FIG. 5). Here, since the generator 37 is driven by the rotation of the crankshaft 25, the output of the electric power is at a minimum when the piston 19 (see FIG. 2) arrives at the compression top dead center with the small rotational force of the crankshaft 25.

Figure 3:
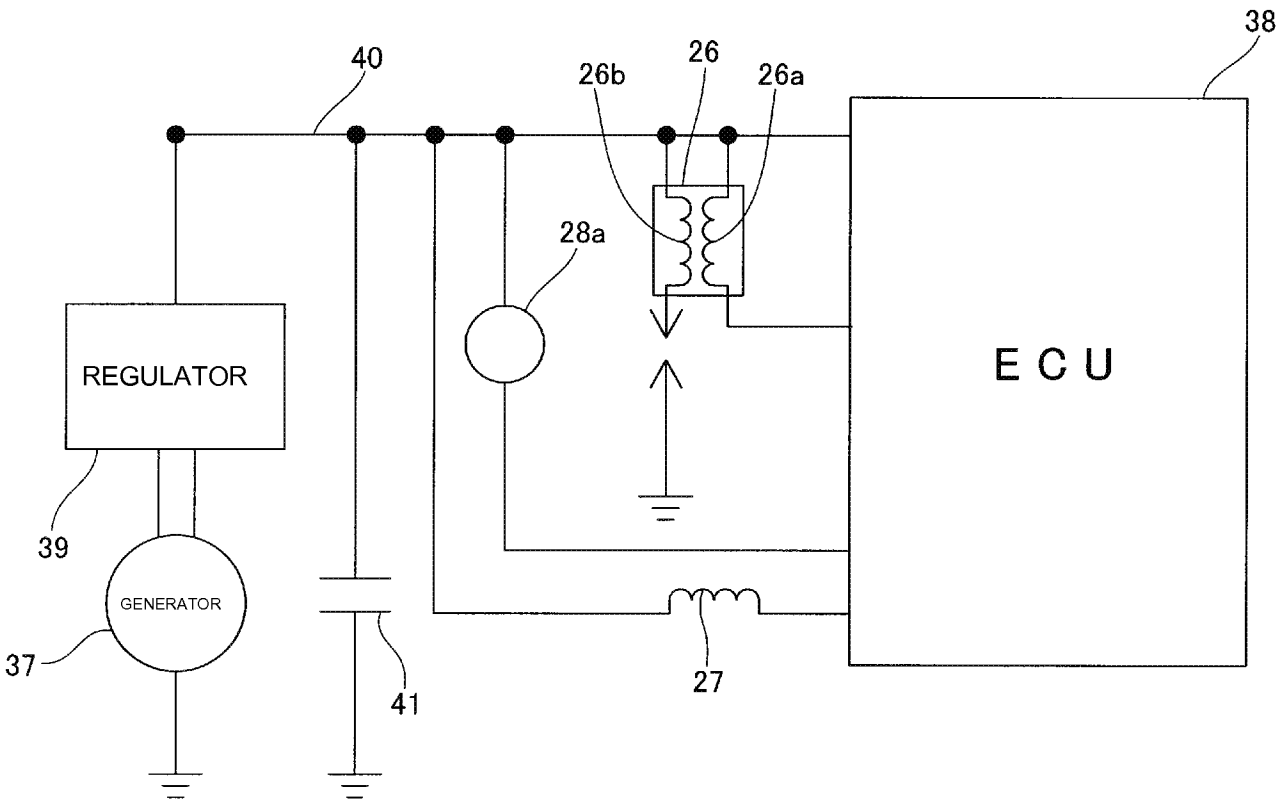
FIG. 3 is a block diagram showing a circuit configuration of the motorcycle shown in FIG. 1.

In the present embodiment, the ECU 38 is electrically connected to the generator 37, as shown in FIG. 3. Specifically, a regulator 39 is electrically connected to the generator 37, and the regulator 39 is connected to the ECU 38 via wiring 40. A capacitor 41 having one end grounded is connected to the wiring 40. Accordingly, the ECU is configured so that the electric power generated by the generator 37 is stabilized by the capacitor 41 and supplied to the ECU 38 after being rectified by the regulator 39. Here, the ECU 38 is an example of a "control module" of the present invention. Other types of control modules may also be used.

Further, the ignition plug 26, the injector 27 and the fuel pump 28*a* are each connected at one end to the generator 37 and the regulator 39 via the wiring 40. Further, the ignition plug 26, the injector 27 and the fuel pump 28*a* are each connected at the other end thereof to the ECU 38. Accordingly, the ECU 38 can control the operation of the ignition plug 26, the injector 27 and the fuel pump 28*a* with the electric power supplied by the generator 37. The ignition plug 26 has a primary coil 26*a* and a secondary coil 26*b*. The ignition plug 26 is configured so that the voltage of the secondary coil 26*b* increases due to electromagnetic induction when the electric power is supplied to the primary coil 26*a* from the generator 37, and so that the voltage of the secondary coil 26*b* momentarily increases when the electric power supply to the primary coil 26*a* is stopped so as to generate a spark. Further, the ECU 38 is configured to control the electric power supply from the generator 37 so as to continuously operate the fuel pump 28*a*. However, the ECU 38 is configured to interrupt the electric power supplied from the generator 37 to the fuel pump 28*a* in the case of stopping. Here, in the present embodiment, the "operation control device for an engine" comprises the kick pedal 17 (see FIG. 1), the generator 37 and the ECU 38.

Figure 5:
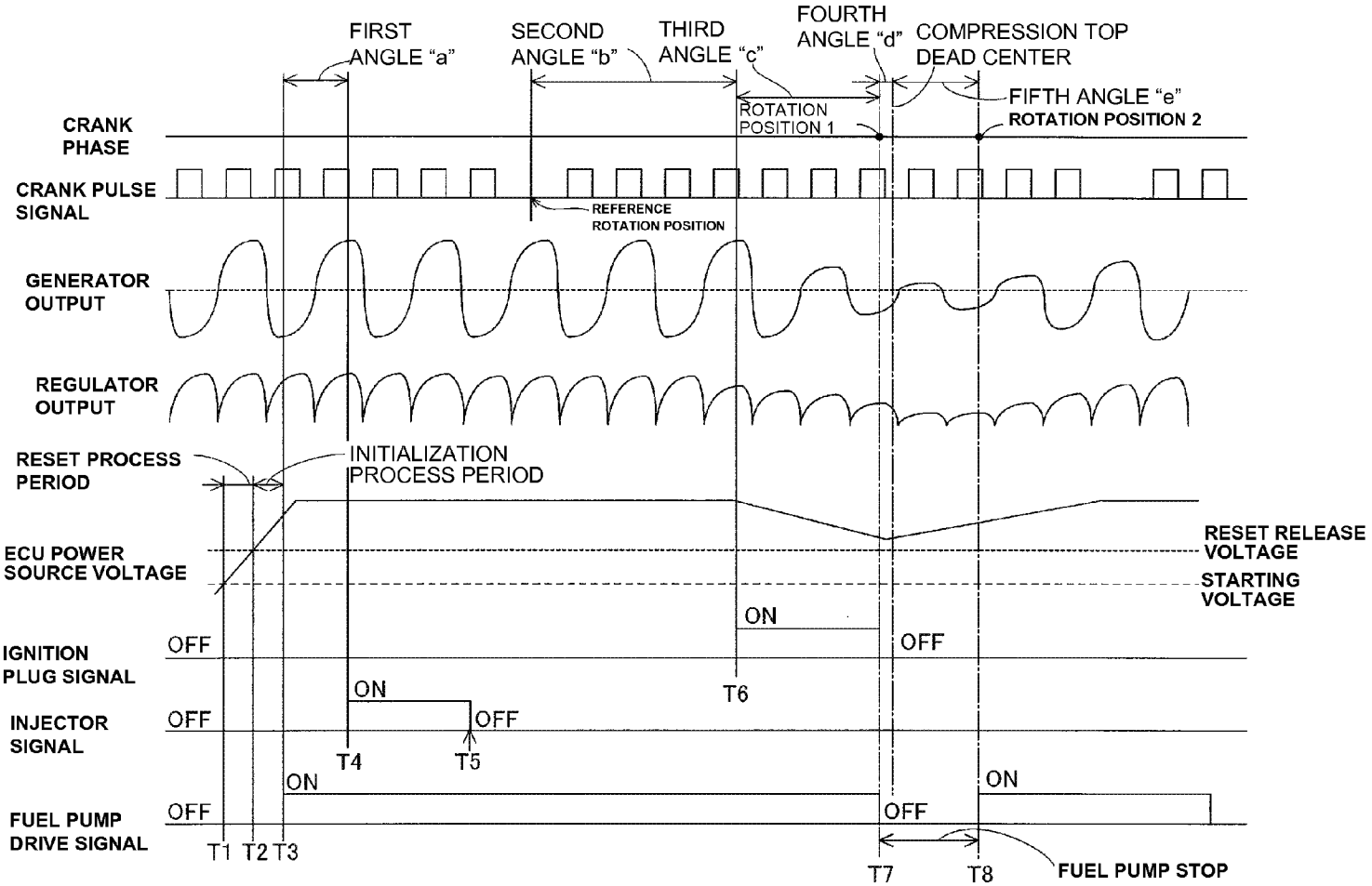
FIG. 5 is a timing chart for explaining the operation of the motorcycle shown in FIG. 1.

In the present embodiment, the ECU 38 is configured to be activated when the voltage reaches a starting voltage level of about 3.0 V or higher with the electric power being supplied by the generator 37, as graphically shown in FIG. 5. The generator 37 is configured to operate in accordance with the rotation of the crankshaft 25 caused by the rotation of the kick pedal 17 (see FIG. 1) with a user's foot. After being activated, the ECU 38 is configured to perform a reset process between the time point at which the voltage is about 3.0 V or higher (timing T1 in FIG. 5) and the time point at which the voltage is at a reset release voltage level of greater than 3.0 V (timing T2 in FIG. 5). In other words, the reset release voltage is greater than the starting voltage.

The reset process is the process to release the selection of one mode among a fuel pump start mode, a fuel pump drive mode and a fuel pump stop mode which are described later. Further, the ECU 38 is configured to perform an initialization process at timing T2 when the ECU voltage is determined to be equal to or greater than the reset release voltage and, if so, to perform a control function to drive the fuel pump 28*a* (ON control) at timing T3. The initialization process is the process in which a start mode of the fuel pump 28*a*, which is initially operated after the fuel pump 28*a* is activated (hereinafter, called the "fuel pump start mode"), is selected by the ECU 38. Further, the ECU 38 is configured to select a drive mode of the fuel pump 28*a* (hereinafter, called the "fuel pump drive mode") to drive the fuel pump 28*a* after termination of the initialization process.

The ECU 38 is also configured to perform two determinations when driving the fuel pump 28*a*. In the present embodiment, the determinations are whether or not the voltage of the ECU 38 is equal to or greater than a fuel pump drive voltage, which is higher than the reset release voltage, and whether or not the revolution speed of the crankshaft 25 is equal to or greater than a first revolution speed. The first revolution speed is the revolution speed of the crankshaft 25 at which sufficient power for operating the ignition plug 26, the injector 27, the fuel pump 28*a* and the ECU 38 can be obtained from the generator 37. Here, the first revolution speed is calculated by the ECU 38 based on the crank pulse signal (see FIG. 5).

As shown in FIG. 5, the ECU 38 is configured to perform an ON control function to supply electric power to the injector 27 from the generator 37 at a timing T4 when the crankshaft 25 has rotated by a first angle "a" relative to its prior position at timing T3 at which the ECU 38 has performed the ON control function to drive the fuel pump 28*a*. Accordingly, fuel is injected by the injector 27 during a period that the crankshaft 25 is rotated by a predetermined angle (e.g., until timing T5). The ECU 38 is configured to then perform a control (OFF control) function to stop supplying fuel to the injector 27 at timing T5, as depicted in FIG. 5.

In the present embodiment, the ECU 38 is configured to perform a control (ON control) function to supply electric power to the ignition plug 26 from the generator 37 at timing T6 at which the crankshaft 25 (see FIG. 2) has rotated by a second angle "b" relative to a reference rotation position (FIG. 5). The ECU 38 is configured to cut the electric power supply (OFF control function) to the ignition plug 26 so that a spark is generated from the ignition plug 26 in the combustion chamber 20*c* of the engine 13 at timing T7 at which the rotation of the crankshaft 25 by a third angle "c" is detected by the crank angle sensor 36 after the electric power is supplied to the ignition plug 26.

The ECU 38 is also configured to cut the electric power supply (OFF control function) to the ignition plug 26 and the fuel pump 28*a* substantially at the same timing (T7 in the present embodiment). Further, the ECU 38 is configured to cut the electric power supply (OFF control function) to the ignition plug 26 and the fuel pump 28*a* before the piston 19 arrives at the compression top dead center. Furthermore, the ECU 38 is configured to select a stop mode of the fuel pump 28*a* (hereinafter, called the "fuel pump stop mode") for stopping the fuel pump 28*a*.

Here, since the ECU 38 is configured to supply electric power simultaneously to the ignition plug 26 and the fuel pump 28*a*, the power source voltage of the ECU 38 decreases accordingly, as shown in FIG. 5.

Figure 6:
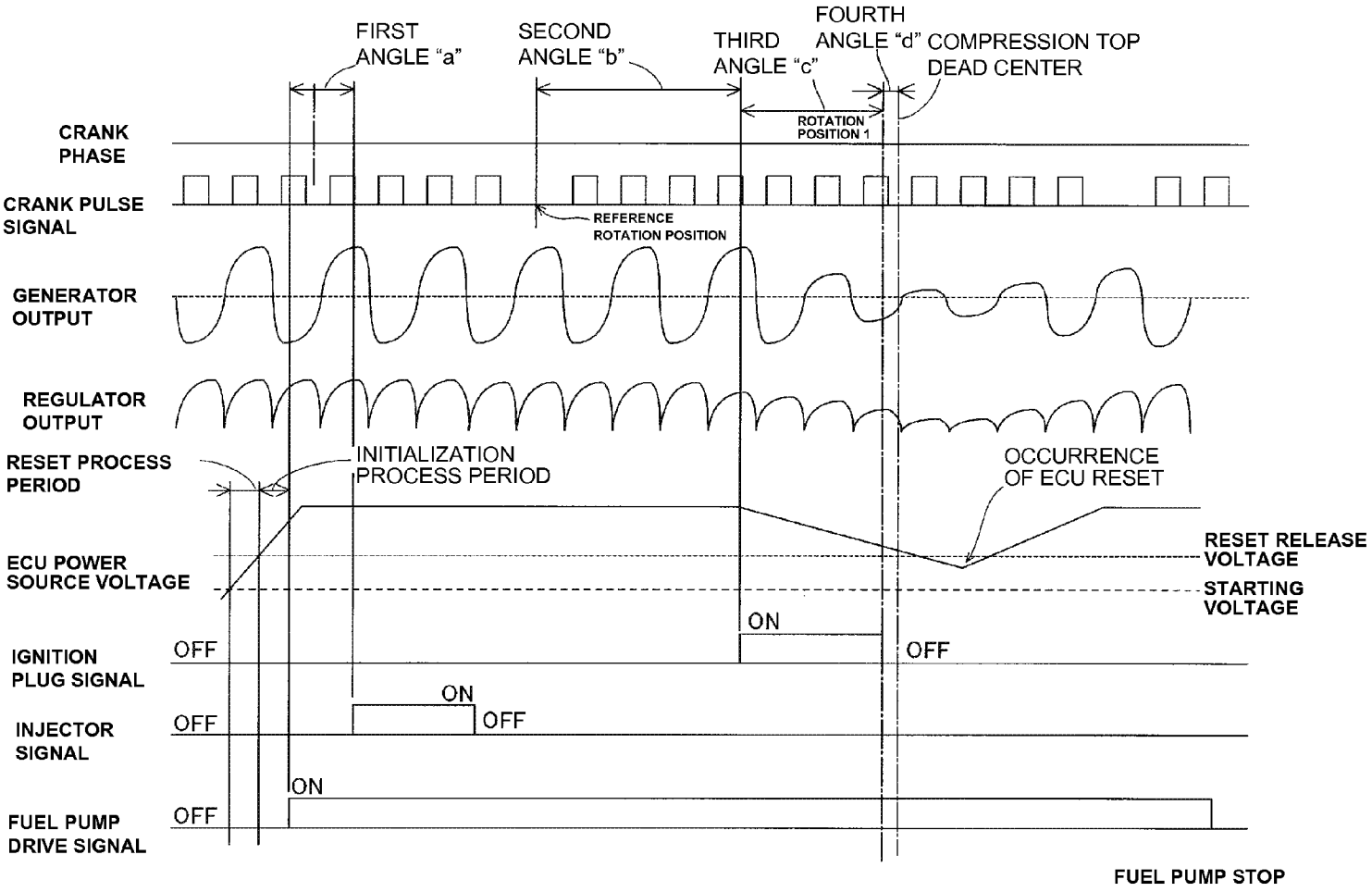
Fig. 6 (Prior Art)
FIG. 6 is a timing chart for explaining the operation of a conventional motorcycle.

In the present embodiment, the piston 19 (see FIG. 2) is configured to arrive at the compression top dead center after the crankshaft 25 has rotated by a fourth angle "d" relative to its prior position at timing T7 (at which the ECU 38 cuts the electric power supply to the ignition plug 26 and the fuel pump 28*a*). The ECU 38 continues the OFF control until timing T8 at which the rotation of the crankshaft 25 by a fifth angle "e" is detected by the crank angle sensor 36 after the piston 19 arrives at the compression top dead center. In other words, the ECU 38 is configured to perform the OFF control function to cut the electric power supply to the fuel pump 28*a* during the period from the stopping of the electric power supply to the ignition plug 26 and the fuel pump 28*a* until the crankshaft 25 is rotated by the sum angle of the fourth angle "d" and the fifth angle "e" (the period from timing T7 to timing T8), which corresponds to a period which the electric power supplied to the ECU 38 is decreased. On the other hand, as shown in FIG. 6, in the case where an ECU is operated in a conventional manner and thus does not perform the OFF control function to stop the fuel pump, there is a possibility that the voltage of the ECU will decrease to a level that is equal to or lower than the reset release voltage depending on the rotation speed of the kick pedal (see FIG. 1). In this case, the ECU performs a reset process. The reset process returns the ECU to a start mode.

In the present embodiment, the ECU 38 is configured to determine that fuel has been combusted by the ignition plug 26 when the revolution speed of the crankshaft 25 is detected to be higher than a second revolution speed detected by the crank angle sensor 36. The second revolution speed is the revolution speed of the crankshaft 25 after the engine 13 is started. Here, in the present embodiment, the ECU 38 is configured to repeat the OFF control function to cut the electric power supply to the fuel pump 28*a* from the abovementioned generator 37 until the occurrence of the first combustion is determined.

Figure 7:
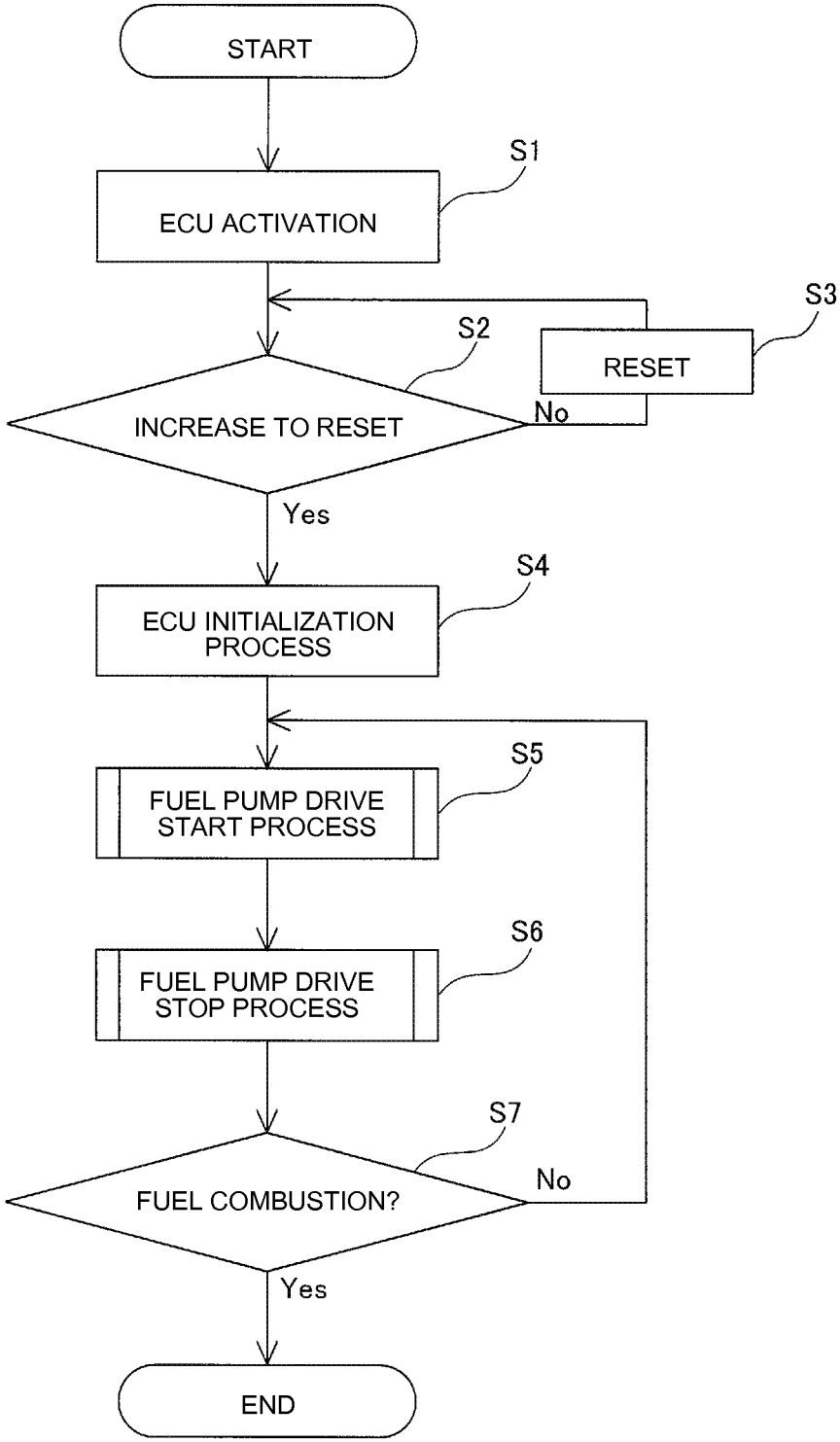
FIG. 7 is a flowchart showing a process for controlling a fuel pump of the motorcycle shown in FIG. 1.
Figure 8:
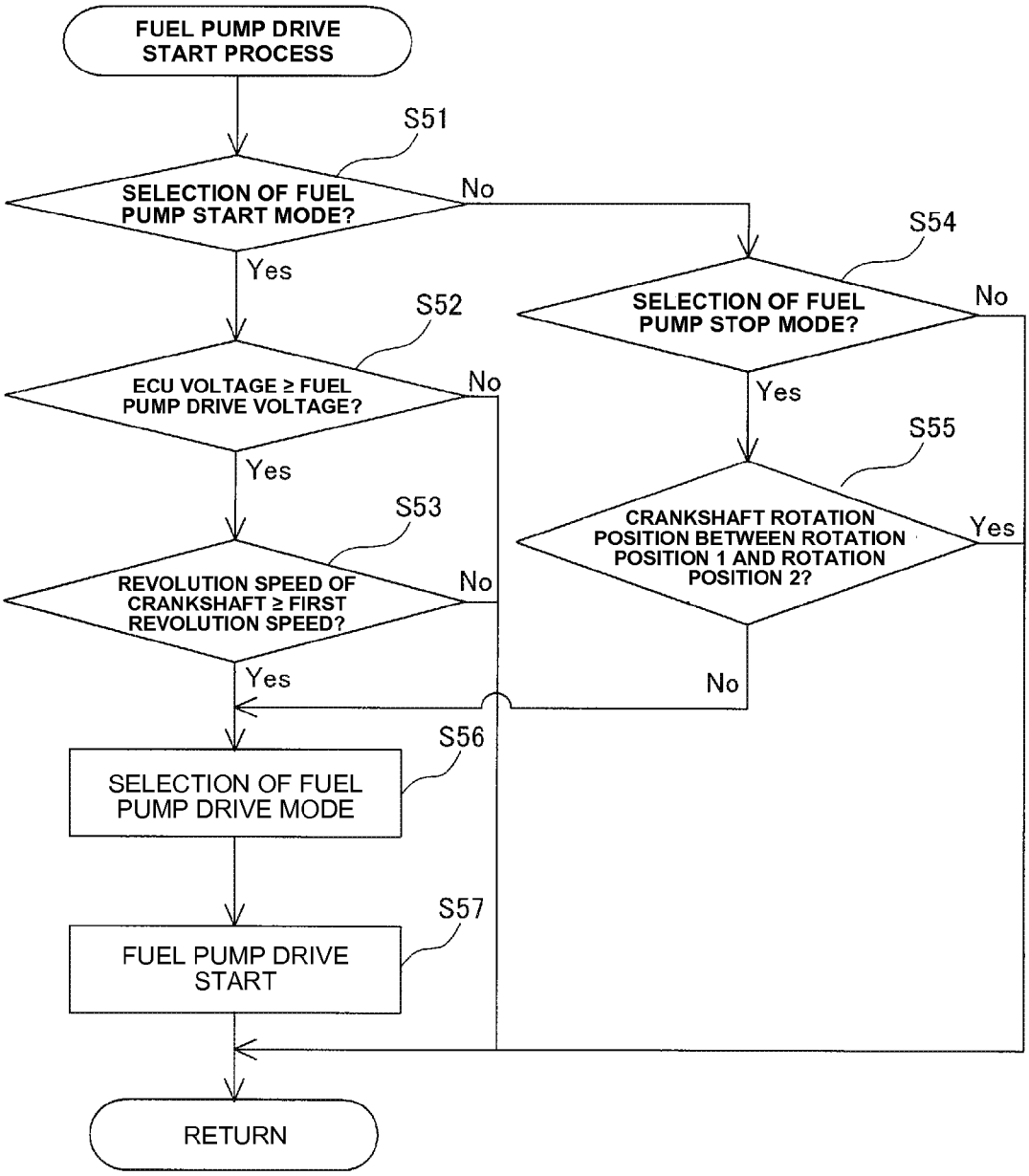
FIG. 8 is a flow chart showing a fuel pump drive start process of the motorcycle shown in FIG. 7.
Figure 9:
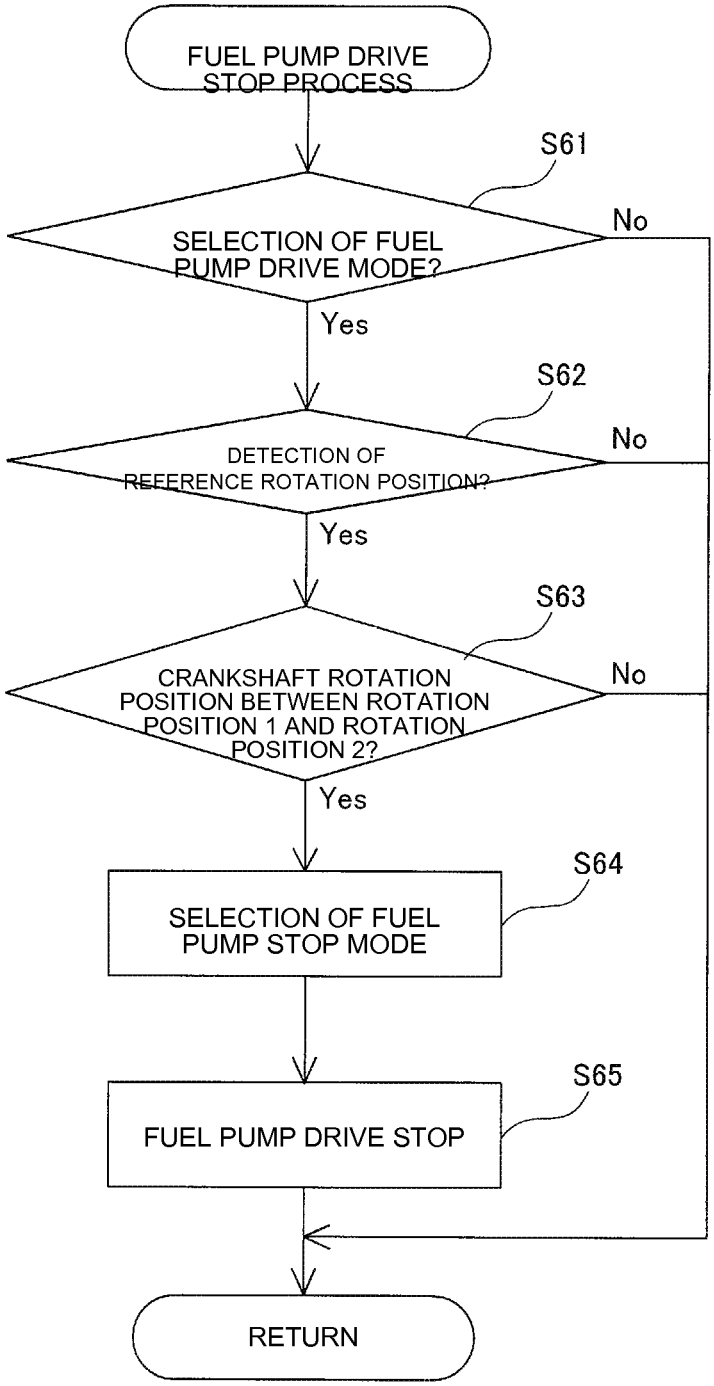
FIG. 9 is a flow chart showing a fuel pump drive stop process of the motorcycle shown in FIG. 7.

FIG. 7 to FIG. 9 are flowcharts for explaining the control of the fuel pump at starting of an engine of the motorcycle, shown in FIG. 1, according to the embodiment of the present invention. The control operation of the ECU 38 at the starting of the engine 13 of the motorcycle 1 is described with reference to FIG. 2, FIG. 5 and FIG. 7 to FIG. 9.

First, as shown in FIG. 7, the crankshaft 25 is rotated by the rotation of the kick pedal 17 with a user's foot and when the voltage of the ECU 38 becomes about 3.0 V or higher, so that the starting voltage is reached, the ECU 38 is activated in step S1, and the process proceeds to step S2. Then, in step S2, it is determined whether or not the voltage of the ECU 38, to which electric power is supplied from the generator 37, is equal to or greater than the reset release voltage, which is the reset voltage. When the voltage of the ECU 38 is determined to be not equal to or greater than the reset release voltage in step S2, the process goes to step S3, in which the reset process of the ECU 38 is performed, and the process then returns to step S2. The reset process is performed (as recited hereinabove) to release the selection of one mode among the fuel pump start mode, the fuel pump drive mode and the fuel pump stop mode. Here, the operations of step S2 and step S3 are repeated until the voltage of the ECU 38 is determined to be equal to or greater than the reset release voltage in step S2.

When the voltage of the ECU 38 is determined to be equal to or greater than the reset release voltage in step S2, the process proceeds to step S4. In step S4, the initialization process of the ECU 38 is performed and the fuel pump start mode is selected. The process proceeds to step S5, in which fuel pump drive start process is performed, and the process then proceeds to step S6. In step S6, the fuel pump stop process is performed, and the process proceeds to step S7. In step S7, it is determined whether or not the crankshaft 25 is rotating at a speed equal to or greater than the second revolution speed. When it is determined that the crankshaft 25 is rotating below the second revolution speed in step S7, the process returns to step S5. When it is determined that the crankshaft 25 is rotating at a speed equal to or greater than the second revolution speed in step S7, the engine 13 is determined to have been started and start control process of the engine 13 by ECU 38 is ended.

Next, the operation of the ECU 38 during the fuel pump drive start process in step S5 (see FIG. 7) is described in detail.

First, as shown in FIG. 8, it is determined whether or not the fuel pump start mode has been selected by the ECU 38 (see FIG. 3), in step S51. When the fuel pump start mode is determined to have been selected, the process proceeds to step S52. The case where the fuel pump start mode is determined as not being selected in step S51 is described later.

In step S52, it is determined whether or not the voltage of the ECU 38 is equal to or greater than the fuel pump drive voltage which is higher than the reset release voltage, which is the voltage for reset releasing. When the voltage of the ECU 38 is determined to be lower than the fuel pump drive voltage in step S52, the fuel pump drive start process is ended. When the voltage of the ECU 38 is determined to be equal to or greater than the fuel pump drive voltage in step S52, the process proceeds to step S53, in which it is determined whether or not the crankshaft 25 is rotated at a speed equal to or greater than the first revolution speed. When the crankshaft 25 is determined to be rotated at a speed lower than the first revolution speed in step S53, the fuel pump drive start process is ended. When the crankshaft 25 is determined to be rotated at a speed equal to or greater than the first revolution speed in step S53, the process proceeds to step S56.

When the fuel pump start mode is determined as not being selected in step S51, the process proceeds to step S54. In step S54, it is determined whether or not the fuel pump stop mode is selected. When the fuel pump stop mode is determined as not being selected in step S54, the fuel pump 28*a* is determined to be in operation and the fuel pump drive start process is ended. When the fuel pump stop mode is determined to be selected in step S54, the process proceeds to step S55.

In step S55, it is determined whether or not the rotation position of the crankshaft 25 is located between the rotation position 1 (see FIG. 5), which is the position rotating by the sum angle of the second angle "b" (see FIG. 5) and the third angle "c" from the reference rotation position, and the rotation position 2 (see FIG. 5), which is the position rotating by the sum angle of the fourth angle "d" (see FIG. 5) and the fifth angle "e" (see FIG. 5) from the rotation position 1. When the rotation position of the crankshaft 25 is determined to be located between the rotation position 1 and the rotation position 2 in step S55, the pump drive start process is ended. When the rotation position of the crankshaft 25 is determined as not being located between the rotation position 1 and the rotation position 2 in step S55, the process proceeds to step S56.

Then, the fuel pump drive mode is selected in step S56, and the process proceeds to step S57. Then, the fuel pump 28*a* is driven in step S57, and the pump drive start process is ended.

Next, the process operation of the ECU 38 in the fuel pump drive stop process in step S6 (see FIG. 7) is described in detail.

First, as shown in FIG. 9, it is determined whether or not the fuel pump drive mode is selected by the ECU 38 (see FIG. 3), in step S61. When the fuel pump drive mode is determined as not being selected in step S61, the fuel pump 28*a* is determined as not being in operation and the fuel pump drive stop process is ended. When the fuel pump drive mode is determined to be selected in step S61, the process proceeds to step S62. In step S62, it is determined whether or not the reference rotation position (see FIG. 5) of the crankshaft 25 has been detected by the crank angle sensor 36 (see FIG. 2). When the reference rotation position of the crankshaft 25 is determined as not being detected in step S62, the pump drive stop process is ended. When the reference rotation position of the crankshaft 25 is determined to have been detected by the crank angle sensor 36 in step S62, the process proceeds to step S63.

In step S63, it is determined whether or not the rotation position of the crankshaft 25 is located between the rotation position 1 (see FIG. 5) and the rotation position 2 (see FIG. 5). When the rotation position of the crankshaft 25 is determined as not being located between the rotation position 1 and the rotation position 2 in step S63, the fuel pump drive stop process is ended. When the rotation position of the crankshaft 25 is determined to be located between the rotation position 1 and the rotation position 2 in step S63, the process proceeds to step S64. In step S64, the fuel pump stop mode is selected, and the process proceeds to step S65. In step S65, the drive of the fuel pump 28*b* is stopped, and the fuel pump drive stop process is ended.

Here, when, during the operation control of the ECU 38 in FIG. 7 to FIG. 9, the voltage of the ECU 38 drops below the reset release voltage, which is the voltage for reset releasing, the ECU 38 forcefully terminates the controls in the above-mentioned steps and performs the reset process.

As mentioned above, in the present embodiment, the ECU 38 is configured to perform the OFF control function to cut the electric power supply to the fuel pump 28*a* when the piston 19 arrives at least at the compression top dead center. Accordingly, the electric power supply to the fuel pump 28*a* is stopped in the case where the amount of power generated by the generator 37 is decreased due to the decrease of the sliding speed of the piston 19 in accordance with the arriving of the piston 19 at the compression top dead center. Therefore, the amount of the electric power supplied to the ECU 38 can be more reliably maintained above the reset release voltage because electric power is not being supplied to the fuel pump 28*a*. Consequently, electric power shortage for the ECU 38 can be suppressed. In this manner, operation of the ECU 38 can be suppressed from being stopped even in the case where the electric power generated by the generator 37 is decreased due to the decrease of the drive force of the engine 13.

In the present embodiment, as mentioned above, the ECU 38 is configured to perform the OFF control function to cut the electric power supply to the fuel pump 28*a* when the crankshaft 25 is positioned at the fourth angle "d" before the piston 19 arrives at the compression top dead center and to perform the ON control function to restore the electric power supply to the fuel pump 28*a* when the crankshaft 25 is rotated by the fifth angle "e" after the position 19 arrives at the compression top dead center. Accordingly, the electric power supply to the fuel pump 28*a* can be reliably stopped in the case where the piston 19 is positioned in the vicinity of the compression top dead center at which the amount of power generated by the generator 37 is decreased in accordance with the decrease of the sliding speed of the piston 19. In this manner, the electric power to be supplied to the ECU 38 can be reliably ensured in the case where the amount of power generated by the generator 37 is decreased.

In the present embodiment, as mentioned above, the ECU 38 is configured to perform the OFF control function to cut the electric power supply to the ignition plug 26 when the crankshaft 25 is positioned at the fourth angle "d" before the piston 19 arrives at the compression top dead center. Accordingly, the electric power supply to the ignition plug 26 can be stopped before the piston 19 arrives at the vicinity of the compression top dead center at which the amount of power generated by the generator 37 is decreased. In this manner, the reliability of electric power to be supplied to the ECU 38 can be further ensured.

In the present invention, as mentioned above, the ECU 38 is configured to perform the OFF control function to cut the electric power supply to the ignition plug 26 and fuel pump 28*a* substantially at the same timing. Accordingly, the electric power supply to both of the ignition plug 26 and the fuel pump 28*a* can be stopped before the piston 19 arrives in the vicinity of the compression top dead center at which the amount of power generated by the generator 37 is decreased. As a result, the electric power to be supplied to the ECU 38 can be further ensured reliably.

In the present embodiment, as mentioned above, the ECU 38 is configured to be activated with the electric power generated from the generator 37, which is driven by the kick pedal 17, and to perform the control functions to supply and stop the electric power to the fuel pump 28*a* until the occurrence of the first fuel combustion is determined thereafter. Accordingly, the voltage of the ECU 38 can be suppressed from dropping below the reset release voltage which is the voltage for reset releasing caused by the decrease of the electric power supplied from the generator 37 at the time of starting in which the output of the generator 37 is small. The ECU 38 can be also configured to perform the control functions to supply and stop the electric power to the fuel pump 28*a* only at the time of starting. Namely, the ECU 38 can be configured not to perform the OFF control function of the fuel pump 28*a* after the engine 13 is started.

In the present embodiment, as mentioned above, the ECU 38 is configured to cut the electric power supply to the fuel pump 28*a* every time the piston 19 arrives at the compression top dead center until the fuel injected by the injector 27 is combusted in the engine 13. Accordingly, fuel ignition by the ignition plug 26 can be performed a number of times while ensuring the reliability of electric power supply for the ECU 38. This facilitates starting of the engine 13 by the user.

In the present embodiment, as mentioned above, the ECU 38 is configured to perform the control functions to supply and stop the electric power to the ignition plug 26, the injector 27 and the fuel pump 28*a* based on the rotational angle position of the crankshaft 25 which is detected by the crank angle sensor 36. Accordingly, the ECU 38 can perform the control functions to supply and stop the electric power to the ignition plug 26, the injector 27 and the fuel pump 28*a* based on the rotational angle position of the crankshaft 25 detected by the crank angle sensor 36 which is normally disposed at the engine 13.

Note that the embodiments disclosed here in are examples in all the aspects and should not be considered restrictive. The scope of the present invention is to be determined based on the scope of appended claims and not by the abovementioned explanation of the embodiments. Further, the scope of the present invention includes equivalents to the scope of the appended claims and all modifications within the scope of the appended claims.

For example, in the abovementioned embodiments, examples in which the vehicle of the present invention is applied to a motorcycle are shown. However, the invention is not limited to motorcycles. Rather, the present invention is also applicable to other vehicles, such as automobiles, tricycles, and ATVs (All Terrain Vehicles).

Further, examples in which the vehicle is applied to an off-road motorcycle are shown in the abovementioned embodiments. However, the invention is not limited to this, as the vehicle of the present invention is also applicable to on-road motorcycles and vehicles.

Furthermore, examples in which the operation control device for an engine of the present invention is applied to an engine of a motorcycle which is kick started are shown in the abovementioned embodiments. However, the invention is not limited to this, as the present invention is also applicable to a drive device for an engine which is started with electric power which is manually generated with a user's hand or foot, such as electrical generators and chain saws.

Moreover, examples in which the ECU performs the OFF control function to stop the electric power supply to the fuel pump when the piston is in the vicinity of arriving at the compression top dead center are shown in the abovementioned embodiments. However, the invention is not so limited, because the present invention, for example, can also be configured to perform the control to stop the electric power to the fuel pump only once the piston arrives at the compression top dead center.

Further, examples in which the ECU performs the control to stop the electric power supply to the ignition plug and the control to stop the electric power supply to the fuel pump substantially simultaneously are shown in the abovementioned embodiments. However, the invention is not so, as the present invention, for example, can also be configured to perform the OFF control function to cut the electric power to the fuel pump before or after performing the OFF control function to cut the electric power supply to the ignition plug.

In addition, examples in which the OFF control function to stop the fuel pump by the ECU is terminated after the engine is started are shown in the abovementioned embodiments. However, the invention is not so limited, because the present invention, for example, can also be configured so that the ECU can continue to perform the stop control of the fuel pump after the engine is started.

It is to be clearly understood that the above description was made only for purposes of an example and not as a limitation on the scope of the invention as claimed herein below.

What is claimed:

1. An operation control system for an engine including a piston and which is designed to be started utilizing electric power manually generated by a force from a human's hand or foot, the operation control system comprising:

a control module configured to control an electric fuel pump to supply fuel to a fuel injection device which injects fuel to the engine, wherein the control module is configured to start cutting electric power to the electric fuel pump and to an ignition plug when the piston is sliding up towards or arrives at a position of compression top dead center, and to restore the electric power to the electric fuel pump after the piston arrives at the compression top dead center.

2. The operation control system of claim 1, wherein the control module is further configured to start cutting the electric power to the electric fuel pump during a predetermined period which includes a time when the piston arrives at the compression top dead center.

3. The operation control system of claim 2, wherein the control module is further configured to start cutting the electric power to the electric fuel pump during a first period before the piston arrives at the compression top dead center.

4. The operation control system of claim 1, wherein the control module is further configured to start cutting the electric power to the ignition plug and the electric fuel pump before the piston arrives at the compression top dead center.

5. The operation control system of claim 1, further comprising:

a power generator which supplies electric power to the control module and the electric fuel pump; and a manual start device that manually drives the power generator to generate electric power to start the engine, wherein the control module is configured to be activated with the electric power from the power generator driven by the manual start device at a time of starting the engine and to supply and to start cutting the electric power to the electric fuel pump during a period after being activated.

6. The operation control system of claim 5, wherein, at the time of starting the engine, the control module is configured to be activated when the electric power supplied from the power generator becomes equal to or greater than a first electric power level, to perform an initialization process after the control module is activated and while the electric power supplied from the power generator is equal to or greater than the first electric power level and smaller than a second electric power level which is greater than the first electric power level, and then to perform a control function to start driving of the electric fuel pump when the electric power supplied by the power generator is determined to be equal to or greater than the second electric power level.

7. The operation control system of claim 6, wherein the control module is configured to perform a control function to start cutting the electric power to the electric fuel pump when the piston is in a vicinity of the compression top dead center as the electric power supplied by the power generator becomes smaller than the second electric power level.

8. The operation control system of claim 1, wherein, at a time of starting the engine, the control module is configured to start cutting the electric power to the electric fuel pump every time the piston arrives at the compression top dead center until fuel injected by the fuel injection device combusts in the engine.

9. The operation control system of claim 1, further comprising a sensor arranged to detect a rotation position of a crankshaft which is rotated by a drive of the piston, wherein the control module is configured to perform a control function to start cutting the electric power to the electric fuel pump based on the rotation position of the crankshaft, the crankshaft rotation position being detected by the sensor.

10. A vehicle, comprising:

an engine including a piston;

a fuel injection device which injects fuel to the engine;

an electric fuel pump that supplies fuel to the fuel injection device;

a power generator which supplies electric power to drive the fuel injection device and the electric fuel pump;

a manual start device that manually drives the power generator to generate electric power to start the engine; and a control module which controls driving of the fuel injection device and the electric fuel pump, the control module being supplied with electric power by the power generator, wherein the control module is configured to start cutting the electric power to the electric fuel pump and to an ignition plug when the piston is sliding up towards or arrives at a position of compression top dead center, and to restore the electric power to the electric fuel pump after the piston arrives at the compression top dead center.

11. An operation control system for an engine including a piston, the system comprising a control module configured to drive an electric fuel pump which supplies fuel to a fuel injection device of the engine and to start cutting electric power to the electric fuel pump and to an ignition plug when the piston is sliding up towards or arrives at a position of compression top dead center, and to restore the electric power to the electric fuel pump after the piston arrives at the compression top dead center.

12. The operation control system of claim 11, wherein the control module is configured to perform two determination routines when driving the electric fuel pump, and wherein one of the two determination routines determines whether or not a voltage of the control module is equal to or greater than an electric fuel pump drive voltage which is higher than a reset release voltage for the control module, and another one of the two determination routines examines whether or not a revolution speed of a crankshaft of the engine is equal to or greater than a first revolution speed.

13. The operation control system of claim 12, wherein the first revolution speed is defined as the revolution speed of the crankshaft at which sufficient power to operate the ignition plug, the fuel injection device, the electric fuel pump and the control module can be obtained from a power generator operatively coupled to the ignition plug, the fuel injection device, the electric fuel pump and the control module.

14. The operation control system of claim 13, wherein the control module is configured to calculate the first revolution speed based on a detection signal received from a crank pulse sensor.

15. An engine control method, the method comprising the steps of:

(a) using an electric fuel pump to supply fuel to a manually started engine including a piston, the electric fuel pump being coupled to an electric power supply; and (b) start cutting electric power to the electric fuel pump and to an ignition plug when the piston is sliding UP towards or arrives at a position of compression top dead center; wherein the start of cutting the electric power to the electric fuel pump is during a first period before the piston arrives at the compression top dead center, and the method further includes the step of restoring the electric power to the electric fuel pump following a second period after the piston arrives at the compression top dead center.

16. An engine control method according to claim 15, wherein the first period is defined by a first crankshaft rotation position before the compression top dead center, and the second period is defined by a second crankshaft rotation position after the compression top dead center.

17. An engine control module configured to drive a fuel pump which supplies fuel to a fuel injection device of an engine and to start cutting electric power to the fuel pump and to an ignition plug when a piston of the engine is sliding up towards or arrives at a position of compression top dead center; wherein the control module is configured to start cutting the electric power to the fuel pump during a first period before the piston of the engine arrives at the compression top dead center and to restore the electric power to the fuel pump following a second period after the piston arrives at the compression top dead center.

18. The engine control module according to claim 17, wherein the control module is further configured to start cutting the electric power to the ignition plug before the piston arrives at the compression top dead center.

19. An engine control module for an engine including a piston connected to a crankshaft and which is designed to be started utilizing electric power manually generated by a force from a human's hand or foot, the engine control module configured to:

determine a rotational position of the crankshaft based on a detection signal from a crank angle sensor;

control operation of an ignition plug by enabling electric power to be supplied to the ignition plug at a first crankshaft rotational position before compression top dead center of the piston and to start cutting electric power supplied to the ignition plug at a second crankshaft rotational position to generate a spark; and control operation of an electric fuel pump to supply fuel to a fuel injection device for the engine, wherein the control module is configured to start cutting electric power to the electric fuel pump at a third crankshaft rotational position and restore the electric power to the electric fuel pump at a fourth crankshaft rotational position, the third crankshaft rotational position being located after the first rotational position and at or before the crankshaft rotational position corresponding to the compression top dead center, and the fourth crankshaft rotational position being located after the crankshaft rotational position corresponding to the compression top dead center.

20. The engine control module according to claim 19, wherein the second crankshaft rotational position and the third crankshaft rotational position are substantially the same.

21. The engine control module according to claim 19, wherein the fourth crankshaft rotational position is greater than or equal to 15° and less than or equal to 60° after the compression top dead center.

* * * * *